US005666020A

United States Patent [19]

Takemura

[11] Patent Number: 5,666,020

[45] Date of Patent: Sep. 9, 1997

[54] FIELD EMISSION ELECTRON GUN AND METHOD FOR FABRICATING THE SAME

[75] Inventor: Hisashi Takemura, Tokyo, Japan

[73] Assignee: NEC Corporation, Tokyo, Japan

[21] Appl. No.: 558,520

[22] Filed: Nov. 16, 1995

[30] Foreign Application Priority Data

Nov. 16, 1994 [JP] Japan ..... 6-281045

[51] Int. Cl.[6] ..... H01J 1/46; H01J 21/10; H01J 1/02; H01J 1/16; H01J 19/40

[52] U.S. Cl. ..... 313/306; 313/309; 313/336; 313/495

[58] Field of Search ..... 313/309, 311, 313/336, 346 R, 351, 495; 445/50, 51

[56] References Cited

U.S. PATENT DOCUMENTS

| | | | |
|---|---|---|---|
| 3,970,887 | 7/1976 | Smith et al. | 313/336 X |
| 5,199,917 | 4/1993 | MacDonald | 313/336 X |
| 5,204,581 | 4/1993 | Andreadakis et al. | 313/309 X |
| 5,394,006 | 2/1995 | Liu | 313/336 X |
| 5,576,594 | 11/1996 | Toyoda | 313/309 |

FOREIGN PATENT DOCUMENTS

| | | |
|---|---|---|
| 4-94033 | 3/1992 | Japan . |
| 5-36345 | 2/1993 | Japan . |
| 6-20592 | 1/1994 | Japan . |
| 6-52788 | 2/1994 | Japan . |

OTHER PUBLICATIONS

C. Spindt et al., "Physical properties of thin-film field emission cathodes with molybdenum cones" *Journal of Applied Physics*, vol. 47, No. 12, Dec. 1976.

*Primary Examiner*—Sandra L. O'Shea
*Assistant Examiner*—Mark Haynes
*Attorney, Agent, or Firm*—Young & Thompson

[57] ABSTRACT

The present invention provides an emitter structure of a field emission electron gun. The emitter structure comprises an emitter being electrically conductive and being pointed at the top, wherein the top of the emitter has the highest resistance of every other part, so that the top of the emitter has the highest heat energy of every other part when the emitter emits electrons.

74 Claims, 6 Drawing Sheets

FIELD EMISSION ELECTRON GUN AND METHOD FOR FABRICATING THE SAME

BACKGROUND OF THE INVENTION

The present invention relates to a field emission electron gun with an improved emitter and a method for fabricating the same.

A conventional field emission electron gun with molybdenum cone emitters which are sharp-pointed is disclosed in Journal of Applied Physics, Vol. 47, No. 12, December 1976. It is necessary to process molybdenum at high accuracy to form the molybdenum cone emitters on a silicon substrate. It is, in fact, difficult to process molybdenum at a high accuracy. For this reason, it is effective to use silicon for cone-shape emitters since it is relatively easy to process silicon at a high accuracy. In the Japanese laid-open patent applications Nos. 4-94033 and 6-52788, it is disclosed to use silicon for cone-shape emitters in the field emission electron gun.

In order to obtain a stable current property of the field emission electron gun, it is effective to connect a high resistance in series to the emitter such as a silicon base emitter. One of the typical conventional field emission electron gun is disclosed in the Japanese laid-open patent application No. 6-20592, a structure of which is illustrated in FIG. 1, wherein an illustration of a collector electrode is omitted. In practice, many field emission electron guns are provided in matrix on an n-doped silicon substrate 1. An emitter electrode, which is not illustrated, may be provided on the bottom of the n-doped silicon substrate 1.

An emitter, which has a cone-like shape and is sharp-pointed at the top, is selectively provided on the top of the n-doped silicon substrate 1. An emitter tip 9, which is made of a polysilicon highly doped with an n-type impurity, is formed at the head of the emitter. The base of the emitter is made of the same material as the silicon substrate 1. The emitter base has a higher resistivity than the resistivity of the emitter tip 9. An insulation film 5 is provided on the top of the silicon substrate 1, to encompass and to be spaced apart from the emitter. A gate electrode 6 is provided on the top of the insulation film 5, to encompass and to be spaced apart from the emitter tip 9.

Anther conventional field emission electron gun is disclosed in the Japanese laid-open patent application No. 5-36345, a structure of which is illustrated in FIG. 2, wherein an illustration of a collector electrode is omitted. In practice, many field emission electron guns are provided in matrix on an n-doped silicon substrate 1. An emitter electrode, which is not illustrated, may be provided on the bottom of the n-doped silicon substrate 1.

An emitter, which has a cone-like shape and is sharp-pointed at the top, is selectively provided on the top of the n-doped silicon substrate 1. The emitter comprises a head, which is made of a low resistive epitaxial silicon 11, and a base, which is made of a high resistive epitaxial silicon 10. The emitter base 10 has a higher resistivity than the emitter head 11. An insulation film 5 is provided on the top of the silicon substrate 1, to encompass and to be spaced apart from the emitter. A gate electrode 6 is provided on the top of the insulation film 5, to encompass and to be spaced apart from the emitter tip 9.

As described above, the head of the emitter has a lower resistivity than that of the base thereof, in order to reduce the ward function associated with the emitter and improve the discharge property. The high resistive base of the emitter can suppress a current fluctuation and obtain a stable discharge current.

As described above, in order to obtain a stable discharge current, it is effective to connect the high resistance in series to the head of the emitter. In designing the field emission electron gun, it is important to precisely control the resistance of the highly resistive portion connected in series to the head of the emitter. If the resistance of the emitter is increased, then the stable discharge current is obtained. It is necessary to design the emitter so that the resistance thereof is equal to or above a predetermined minimum value necessary for obtaining the stability of the discharge current. On the other hand, the high resistivity of the emitter causes a potential drop when a current flows through the emitter. It is necessary to raise the voltage to be applied to the gate electrode by an mount corresponding to the potential drop. The variation in the resistance of the emitter causes in the variation of the potential drop, thereby resulting in a variation of the gate electrode voltage. The resistive part of the emitter should be highly resistive and free from any variation in resistance.

In order to obtain a desirable resistivity, it is necessary that the impurity concentration is equal to or less than $1\times10^{14}$ $cm^{-3}$, when the resistive part of the emitter is made of an impurity doped silicon or an impurity doped epitaxial silicon. In this case, however, it is difficult to precisely control the resistivity of the impurity doped silicon or the impurity doped epitaxial silicon, thereby resulting in difficulty in controlling exactly the resistance of the emitter.

In place of the impurity doped silicon or the impurity doped epitaxial silicon, it is available to use a polysilicon doped with an impurity for the resistive part of the emitter. In this case, the resistivity depends on not only the impurity concentration but also grain size. The matured grain size depends on a temperature of the heat treatment for forming the polysilicon film. Actually, it is, however, difficult to control precisely the temperature of the heat treatment. For this reason, the grain size of the polysilicon film is likely to be variable and not uniform. As a result, the resistivity of the polysilicon film is likely to be variable. Thus, it is difficult to precisely control the resistance of the resistive part of the emitter.

In the above prior art, the head of the emitter is made of a material with a lower resistivity than that of the base of the emitter, in order to prevent any thermal destruction of the head of the emitter. Actually, it is unavoidable that an excess electrical current may accidentally and temporally flow through the emitter at over a predetermined maximum regulation value. The emitter structure is designed so that, even if such excess current at over the predetermined maximum regulation value flows through the emitter accidentally, then only the emitter head, with a low resistance, may be free from any heat destruction and melting. The emitter base is, however, made into the heat destruction or melting states due to its high resistivity, thereby causing a large destruction of the emitter, so that a short circuit may be formed between the emitter and the gate electrode. As a result, it is no longer possible to cause a potential difference between the gate electrode and the silicon substrate by applying a bias between them. This means that it is impossible to apply a gate voltage to the gate electrode. In practice, many field emission electron guns are provided in matrix on a silicon substrate. If the short circuit between the emitter and the gate electrode is formed in at least one of the field emission electron guns, then it is no longer possible to apply the gate voltage to the gate electrode of the remaining field emission electron guns, in which no short circuit between them is formed.

It has been required, for a long time, to develop a novel field emission electron gun with an improved emitter structure, which is free from the above problems.

SUMMARY OF THE INVENTION

Accordingly, it is an object of the present invention to provide a novel field emission electron gun with an improved emitter structure, which is free from any problems and disadvantages as described above.

It is a further object of the present invention to provide a novel method for fabricating a field emission electron gun with an improved emitter structure.

The above and other objects, features and advantages of the present invention will be apparent from the following descriptions.

The present invention provides an emitter structure of a field emission electron gun. The emitter structure comprises an emitter being electrically conductive and being pointed at the top, wherein the top of the emitter has the highest resistance of every other part, so that the top of the emitter has the highest heat energy of every other part when the emitter emits electrons.

Actually, it is unavoidable that an excess electrical current may accidentally and temporally flow through the emitter at over a predetermined maximum regulation value. The emitter structure is designed so that, even if such excess current at over the predetermined maximum regulation value flows through the emitter accidentally, then only the top of the emitter may be broken, melted or deformed by an excess heat generation. If the pointed top is deformed, then any field concentration is no longer generated. For these reasons, every other part of the emitter can be free from any destruction, melting or deformation. It is, therefore, possible to prevent any formation of a short circuit between the emitter and the gate electrode. It is also possible to prevent a large deformation of the emitter. It is moreover possible that only the top of the emitter may be vaporized, thereby resulting in a reduction in the mount of the vaporized contaminant. It is, therefore, possible to prevent any undesirable influence, due to the vaporized contaminant, against the adjacent field emission electron guns. In addition, the head made of polysilicon including oxygen prevents any current fluctuation and provides a high current stability.

The present invention also provides a field emission electron gun on a semiconductor substrate. An emitter is selectively provided on the semiconductor substrate. The emitter is also electrically conductive and pointed at the top. A gate insulation material is selectively provided, on the semiconductor substrate, at a predetermined area around the emitter. A gate electrode is provided on the insulation material, to encompass the top of the emitter and to be spaced apart from the emitter. It is essential that the top of the emitter has the highest resistance of every other part, so that the top of the emitter has the highest heat energy of every other part when the emitter emits electrons.

The present invention further provides a field emission electron gun on a semiconductor substrate. An emitter is electrically conductive and selectively provided on the semiconductor substrate. The emitter has the section area which is simply decreased in a direction toward the top of the emitter so that the emitter is pointed at the top. The emitter comprises a base made of polysilicon including oxygen, and a head placed on the base and made of polysilicon doped with an impurity. A gate insulation material is selectively provided, on the semiconductor substrate, at a predetermined area around the emitter. A gate electrode is provided on the insulation material, to encompass the top of the emitter and to be spaced part from the emitter. The base made of polysilicon including oxygen prevents any current fluctuation and provides a high current stability.

BRIEF DESCRIPTIONS OF THE DRAWINGS

Preferred embodiments of the present invention will be described in detail with reference to the accompanying drawings.

DISCLOSURE OF THE INVENTION

Figure 1:
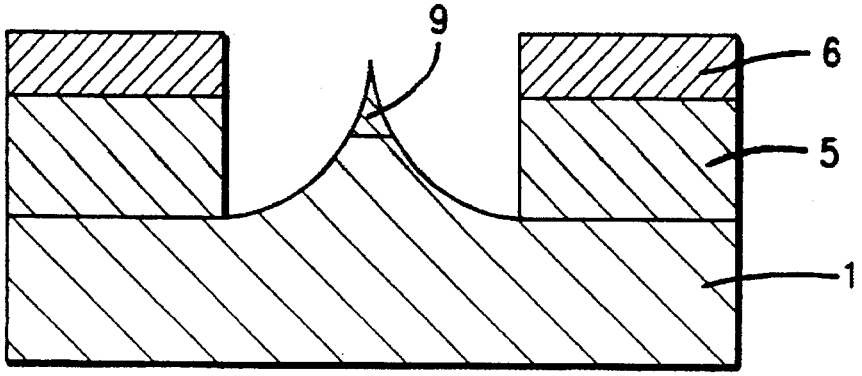
FIG. 1 PRIOR ART
FIG. 1 is a fragmentary cross sectional elevation view illustrative of the conventional field emission electron gun.
Figure 2:
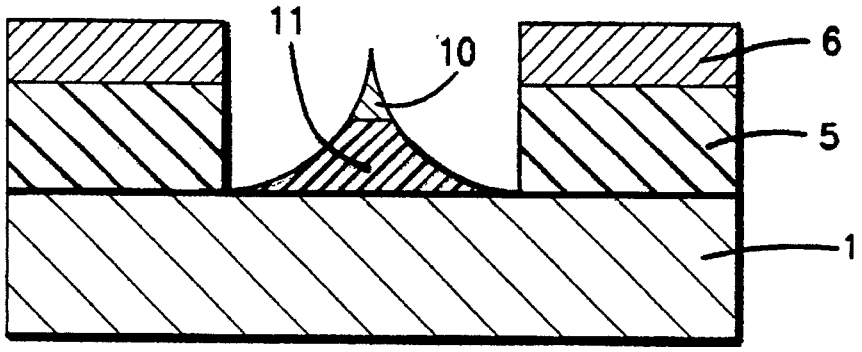
FIG. 2 PRIOR ART
FIG. 2 is a fragmentary cross sectional elevation view illustrative of the other conventional field emission electron gun.

The present invention provides an emitter structure of a field emission electron gun. The emitter structure comprises an emitter being electrically conductive and being pointed at the top, wherein the top of the emitter has the highest resistance of every other part, so that the top of the emitter has the highest heat energy of every other part when the emitter emits electrons.

Actually, it is unavoidable that an excess electrical current may accidentally and temporally flow through the emitter at over a predetermined maximum regulation value. The emitter structure is designed so that, even if such excess current at over the predetermined maximum regulation value flows through the emitter accidentally, then only the top of the emitter may be broken, melted or deformed by an excess heat generation. If the pointed top is deformed, then any field concentration is no longer generated. For these reasons, every other part of the emitter can be free from any destruction, melting or deformation. It is, therefore, possible to prevent any formation of a short circuit between the emitter and the gate electrode. It is also possible to prevent a large deformation of the emitter. It is moreover possible that only the top of the emitter may be vaporized, thereby resulting in a reduction in the mount of the vaporized contaminant. It is, therefore, possible to prevent any undesirable influence, due to the vaporized contaminant, against the adjacent field emission electron guns. In addition, the head made of polysilicon including oxygen prevents any current fluctuation and provides a high current stability.

It is preferable that the emitter has the resistance which is simply increased in a direction toward the top of the emitter. It is also preferable that the emitter has the section area which is simply decreased in a direction toward the top of the emitter. For example, the emitter has either a cone-like shape or a pyramid-like shape.

It is available that the emitter is made of a single conductive material such as a polysilicon, which includes oxygen and is doped with an impurity.

Alternatively, it is also available that the emitter comprises a base made of a first material having a first resistivity, and a head provided on the base. The head is made of a second material having a second resistivity which is higher than the first resistivity, so that the head has a higher heat energy than that of the base when the emitter emits electrons. The first material may be a silicon doped with an impurity, and the second material may be a polysilicon, which includes oxygen and which is doped with an impurity.

It is moreover available that the top of the emitter is coated with a third material having a third resistivity which is lower than the second resistivity. The third material may be silicide such as platinum silicide, titanium silicide, tungsten silicide and molybdenum silicide. Alternatively, the third material may be a metal such as titanium, tungsten and molybdenum. This structure can reduce the value of the work function associated with the emitter, thereby resulting in the improved discharge property of the electron gun.

The present invention also provides a field emission electron gun on a semiconductor substrate. An emitter is selectively provided on the semiconductor substrate. The emitter is also electrically conductive and pointed at the top. A gate insulation material is selectively provided, on the semiconductor substrate, at a predetermined area around the emitter. A gate electrode is provided on the insulation material, to encompass the top of the emitter and to be spaced part from the emitter. It is essential that the top of the emitter has the highest resistance of every other part, so that the top of the emitter has the highest heat energy of every other part when the emitter emits electrons.

Actually, it is unavoidable that an excess electrical current may accidentally and temporally flow through the emitter at over a predetermined maximum regulation value. The emitter structure is designed so that, even if such excess current at over the predetermined maximum regulation value flows through the emitter accidentally, then only the top of the emitter may be broken, melted or deformed by an excess heat generation. If the pointed top is deformed, then any field concentration is no longer generated. For these reasons, every other part of the emitter can be free from any destruction, melting or deformation. It is, therefore, possible to prevent any formation of a short circuit between the emitter and the gate electrode. It is also possible to prevent a large deformation of the emitter. It is moreover possible that only the top of the emitter may be vaporized, thereby resulting in a reduction in the amount of the vaporized contaminant. It is, therefore, possible to prevent any undesirable influence, due to the vaporized contaminant, against the adjacent field emission electron guns. In addition, the head made of polysilicon including oxygen prevents any current fluctuation and provides a high current stability.

It is preferable that the emitter has the resistance which is simply increased in a direction toward the top of the emitter. It is also preferable that the emitter has the section area which is simply decreased in a direction toward the top of the emitter. For example, the emitter has either a cone-like shape or a pyramid-like shape.

It is available that the emitter is made of a single conductive material such as a polysilicon, which includes oxygen and is doped with an impurity.

Alternatively, it is also available that the emitter comprises a base made of a first material having a first resistivity, and a head provided on the base. The head is made of a second material having a second resistivity which is higher than the first resistivity, so that the head has a higher heat energy than that of the base when the emitter emits electrons. The first material may be a silicon doped with an impurity, and the second material may be a polysilicon, which includes oxygen and which is doped with an impurity.

It is moreover preferable that the top of the emitter is coated with a third material having a third resistivity which is lower than the second resistivity. The third material may be silicide such as platinum silicide, titanium silicide, tungsten silicide and molybdenum silicide. Alternatively, the third material may be a metal such as titanium, tungsten and molybdenum. This structure can reduce the value of the work function associated with the emitter, thereby resulting in the improved discharge property of the electron gun.

It is preferable that the gate electrode is made of a metal such as molybdenum, titanium and tungsten.

It is also preferable that the semiconductor substrate comprises a silicon doped with an impurity, and the gate insulation material comprises silicon oxide.

The present invention further provides an emitter of a field emission electron gun. The emitter is electrically conductive and has the section area which is simply decreased in a direction toward the top of the emitter so that the emitter is pointed at the top. The emitter comprises: a base, a head being placed on the base, and a top region being placed on the head. The base is made of polysilicon including oxygen and being doped with an impurity. The head is made of polysilicon including oxygen and is doped with an impurity. The top region is doped with an impurity, wherein the head has the highest resistance of every other part, so that the head has the highest heat energy of every other part when the emitter emits electrons.

Actually, it is unavoidable that an excess electrical current may accidentally and temporally flow through the emitter at over a predetermined maximun regulation value. The emitter structure is designed so that, even if such excess current at over the predetermined maximum regulation value flows through the emitter accidentally, then only the emitter head, except for the top, may be broken, melted or deformed by an excess heat generation. If the emitter head is deformed, then any field concentration is no longer generated. For these reasons, every other part of the emitter can be free from any destruction, melting or deformation. It is, therefore, possible to prevent any formation of a short circuit between the emitter and the gate electrode. It is also possible to prevent a large deformation of the emitter. It is moreover possible that only the emitter head, except for the top, may be vaporized, thereby resulting in a reduction in the amount of the vaporized contaminant. It is, therefore, possible to prevent any undesirable influence, due to the vaporized contaminant, against the adjacent field emission electron guns. In addition, the head made of polysilicon including oxygen prevents any current fluctuation and provides a high current stability. Moreover, the emitter top is made of the oxygen-free polysilicon doped with an impurity, so that the emitter top has a lower resistivity than those of the emitter head and the emitter base. This low resistive emitter top can drop the work function of the emitter. As a result, the discharge property of the field emission electron gun is improved.

PREFERRED EMBODIMENTS

Figure 3:
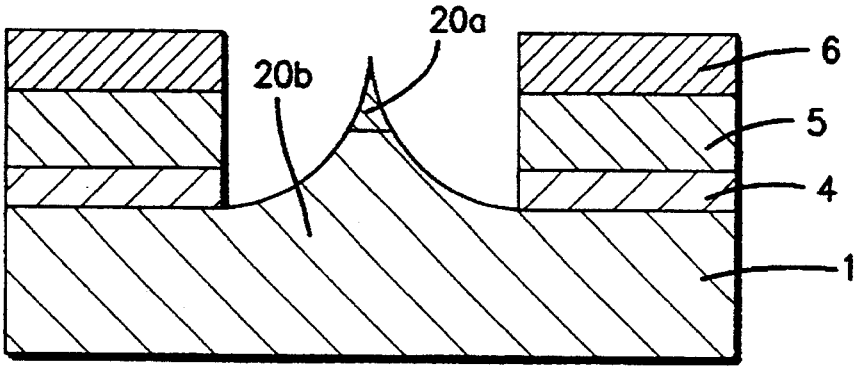
FIG. 3 is a fragmentary cross sectional elevation view illustrative of a novel field emission electron gun with an improved emitter structure in a first embodiment according to the present invention.

A first embodiment according to the present invention will be described in detail with reference to FIGS. 3 and 4A–4D. FIG. 3 illustrates a structure of a novel field emission electron gun, wherein an illustration of a collector electrode is omitted. In practice, many field emission electron guns are provided in matrix on an n-doped silicon substrate 1. An emitter electrode, which is not illustrated, may be provided on the bottom of the n-doped silicon substrate 1.

An emitter 20 is selectively provided on the top of the n-doped silicon substrate 1. The emitter 20 has a cone-like shape and sharp-pointed at the top. The section area of the emitter 20 is simply decreased so that the slope of the side-face of the emitter 20 becomes increasingly steep in a direction toward the top. The emitter 20 comprises two parts: one is a base 20*b* and another is a head 20*a* placed on the base. The base 20*b* of the emitter 20 is made of the same material as the n-doped silicon substrate 1. The base 20*b* of the emitter 20 is formed to be united with the n-doped silicon substrate 1. The head 20*a* of the emitter 20 is made of polysilicon, which includes oxygen. The polysilicon, including oxygen, of the emitter head 20*a* has a larger resistivity than that of the n-doped silicon of the emitter base 20*b*. The resistance of the emitter 20 is inversely proportional to the section area thereof. As described above, the section area of the emitter 20 is simply decreased in the direction toward the top. For those reasons, the resistance of the emitter 20 is simply increased in the direction toward the top, so that the top of the emitter 20 has the highest resistance of every other part thereof. The polysilicon of the emitter head 20*a* has relatively small size crystal grains, wherein the grain size is uniform. The resistivity of the polysilicon depends on the grain size. The uniform grain size provides a uniform resistivity of the polysilicon, namely a uniform resistance of the emitter head 20*a*. This structure can reduce the probability of a current fluctuation.

A silicon oxide film 4 is selectively formed, on the top of the n-doped silicon substrate 1, at a predetermined annular area around the emitter base 20*b*. The silicon oxide film 4 is spaced apart from the emitter base 20*b*. The silicon oxide film 4 has a thickness in the range of 100–400 nanometers. An insulation film 5 is provided on the top of the silicon oxide film 4, to encompass and be spaced apart from the emitter 20. The insulation film 5 is made of silicon oxide and has a thickness in the range of 300–600 nanometers.

A gate electrode 6 made of molybdenum is provided on the top of the insulation film 5, to encompass and be spaced apart from the top of the emitter 20. The gate electrode 6 has a thickness in the range of about 200–300 nanometers.

In fact, it is unavoidable that an excess electrical current may accidentally and temporally flow through the emitter at over a predetermined maximum regulation value. The above emitter structure is designed so that, even if such excess current at over the predetermined maximum regulation value flows through the emitter 20 accidentally and temporally, then only the top of the emitter head 20*a* may be broken, melted or deformed by an excess heat generation. If the pointed top of the emitter head 20*a* is deformed, then any field concentration is no longer generated. For these reasons, every other part of the emitter 20 can be free from any destruction, melting or deformation. It is, therefore, possible to prevent any formation of a short circuit between the emitter 20 and the gate electrode 6. It is also possible to prevent a large deformation of the emitter 20. It is moreover possible that only the top of the emitter 20 may be vaporized, thereby resulting in a reduction in the amount of the vaporized contaminant. It is, therefore, possible to prevent any undesirable influence, due to the vaporized contaminant, against the adjacent field emission electron guns. In addition, the emitter head 20*a* made of polysilicon including oxygen prevents any current fluctuation and provides a high current stability.

Figure 4A:
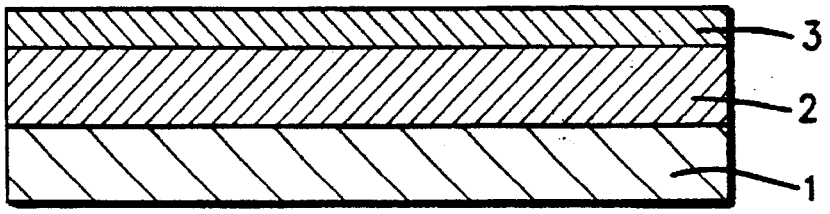
FIGS. 4A–4D are fragmentary cross sectional elevation view illustrative of novel field emission electron guns in sequential processes involved in a fabrication method in a first embodiment according to the present invention.

The above field emission electron gun may be fabricated as follows. As illustrated in FIG. 4A, a silicon substrate 1 is doped with an n-type impurity. A polysilicon film 2, including oxygen and having a thickness about 300 nanometers, is deposited on the top of the n-doped silicon substrate 1 by a chemical vapor deposition method, wherein $N_2O$ gas is added to the normal source gas. The oxygen-containing polysilicon film 2 is doped with an impurity by an ion-implantation. A silicon nitride film 3, having a thickness about 100 nanometers, is deposited on the top of the polysilicon film 2.

Figure 4B:
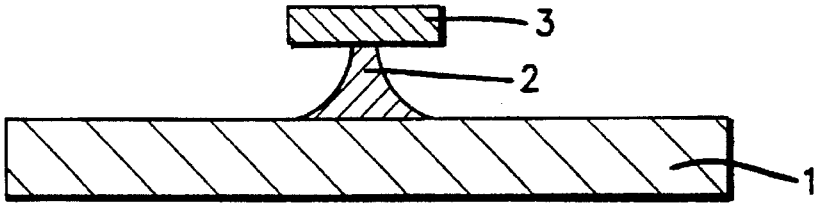

As illustrated in FIG. 4B, a photo-resist film, not illustrated, is applied on the top of the silicon nitride film 3. The photo-resist film is patterned. The silicon nitride film 3 is selectively etched by use of the photo-resist as a mask so that the silicon nitride film 3 remains under the photo-resist film. As a result, the oxygen-containing polysilicon film 2 is partially covered with the remaining silicon nitride film 3. After removing the photo-resist film, the oxygen-containing polysilicon film 2 is subjected to an isotropic etching which uses $SF_6$ gas, thereby resulting in a truncated cone-like oxygen-containing polysilicon 2 under the remaining silicon nitride film 3. The section area of the truncated cone-like oxygen-containing polysilicon 2 is simply decreased so that the slope of the side-face thereof becomes increasingly steep in a direction toward the top.

Figure 4C:
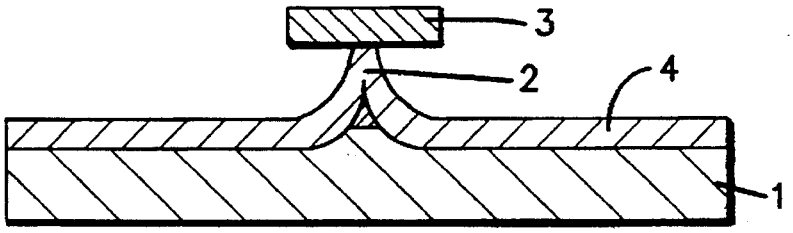

As illustrated in FIG. 4C, the top surface of the silicon substrate 1 and the surface of the truncated cone-like oxygen-containing polysilicon 2 are subjected to a thermal oxidation of silicon. As a result, the top surface of the silicon substrate 1 and the surface of the truncated cone-like oxygen-containing polysilicon 2 are transformed to a silicon oxide film 4. The truncated cone-like shaped oxygen-containing polysilicon 2 is transformed to a sharp-pointed cone oxygen-containing polysilicon 2 under the silicon oxide film 4. A truncated cone-like silicon base is formed under the sharp-pointed cone oxygen-containing polysilicon 2. The truncated cone-like silicon base serves as an emitter base. The sharp-pointed cone oxygen-containing polysilicon 2 serves as an emitter head. The combination of the emitter head and base constitute an emitter which has a cone-like shape and is sharp-pointed at the top. The section area of the emitter is simply decreased so that the slope of the side-face of the emitter becomes increasingly steep in a direction toward the top.

Figure 4D:
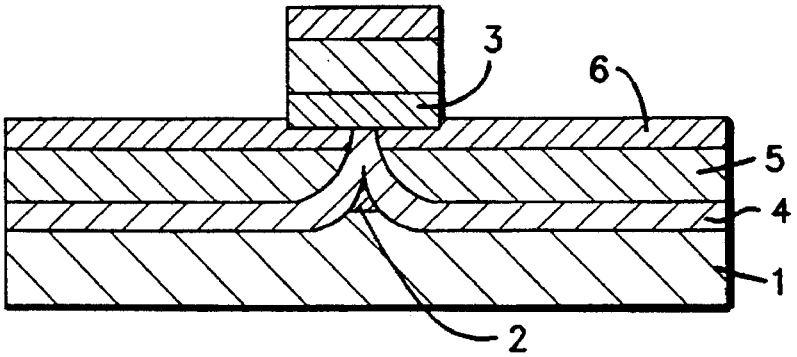

As illustrated in FIG. 4D, a silicon oxide film 5, having a thickness in the range of 300–600 nanometers, is deposited by an evaporation method on the silicon oxide film 4 and on the silicon nitride film 3. A gate electrode film 6, being made of molybdenum and having a thickness in the range of about 200–300 nanometers, is deposited by an evaporation method on the silicon oxide film 5. As a result, the top of the molybdenum gate electrode film 6 is positioned below the top and above the bottom of the silicon nitride film 3. Thus, the side of the silicon nitride film 3 is positioned above the top of the silicon nitride film 3. A surface of the device is then exposed to a liquid, containing a phosphorus acid which etches silicon nitride only. As a result, the entire of the silicon nitride film 3 is etched, thereby the silicon oxide film 5 and the molybdenum gate electrode film 6 over the silicon nitride film 3 are separated from the device. An opening, having the same shape as the silicon nitride film 3, is formed. In this opening, there is the truncated cone-like part of the silicon oxide film 4. The device is then exposed to a fluorine acid, which etches silicon oxide only, so that the truncated cone-like part of the silicon oxide film 4 is etched. As a result, the emitter, which comprises the sharp-pointed cone oxygen-containing polysilicon 2 and the truncated cone-like silicon base, is shown, thereby the fabrication processes of the field emission electron gun is completed.

The resistance of the emitter can readily be controlled by controlling the impurity concentration thereof. As a modification, it is possible to add oxygen by ion-implantation or other method than the chemical vapor deposition method described above. In addition, the emitter head 20*a* may be made of a high resistive material, which is electrically conductive, other than the oxygen-containing polysilicon described above.

Figure 5:
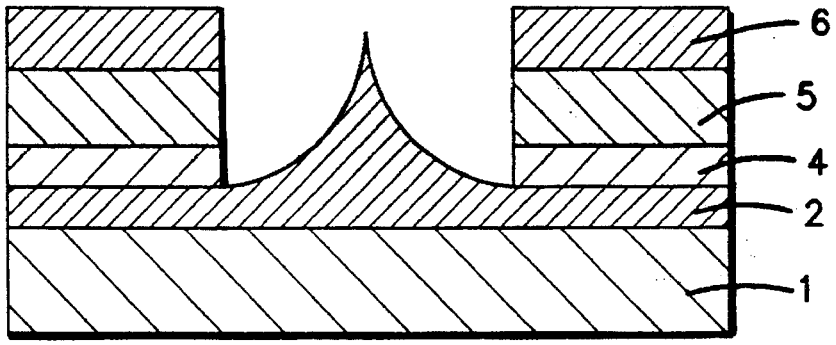
FIG. 5 is a fragmentary cross sectional elevation view illustrative of a novel field emission electron gun with an improved emitter structure in a second embodiment according to the present invention.

A second embodiment according to the present invention will be described in detail with reference to FIG. 5, which illustrates a structure of a novel field emission electron gun. An illustration of a collector electrode is omitted. In practice, many field emission electron guns are provided in matrix on an n-doped silicon substrate 1. An emitter electrode, which is not illustrated, may be provided on the bottom of the n-doped silicon substrate 1. A polysilicon film 2, which is doped with an n-type impurity at a concentration of not less than $1\times10^{15}$ $cm^{-3}$ and includes oxygen, is provided on the top surface of the silicon substrate 1.

An emitter 20, which is made of the same material as the oxygen-containing polysilicon film 2, is selectively provided on the top surface of the oxygen-containing polysilicon film 2. The emitter 20 has a cone-like shape and is sharp-pointed at the top. The section area of the emitter 20 is simply decreased so that the slope of the side-face of the emitter 20 becomes increasingly steep in a direction toward the top. The resistance of the emitter 20 is inversely proportional to the section area thereof. As described above, the section area of the emitter 20 is simply decreased in the direction toward the top. For this reason, the resistance of the emitter 20 is simply increased in the direction toward the top, so that the top of the emitter 20 has the highest resistance of every other part thereof. The polysilicon of the emitter 20 has relatively small size crystal grains, wherein the grain size is uniform. The resistivity of the polysilicon depends on the grain size. The uniform grain size provides a uniform resistivity of the polysilicon, namely a uniform resistance of the emitter 20. This structure can reduce the probability of a current fluctuation.

A silicon oxide film 4 is selectively formed, on the top of the n-doped silicon substrate 1, at a predetermined annular area around the emitter base 20*b*. The silicon oxide film 4 is spaced apart from the emitter 20. The silicon oxide film 4 has a thickness in the range of 100–400 nanometers. An insulation film 5 is provided on the top of the silicon oxide film 4, to encompass and to be spaced apart from the emitter 20. The insulation film 5 is made of silicon oxide and has a thickness in the range of 300–600 nanometers.

A gate electrode 6 made of molybdenum is provided on the top of the insulation film 5, to encompass and be spaced apart from the top of the emitter 20. The gate electrode 6 has a thickness in the range of about 200–300 nanometers.

In fact, it is unavoidable that an excess electrical current may accidentally and temporally flow through the emitter at over a predetermined maximum regulation value. The above emitter structure is designed so that, even if such excess current at over the predetermined maximum regulation value flows through the emitter 20 accidentally and temporally, then only the top of the emitter 20 may be broken, melted or deformed by an excess heat generation. If the pointed top of the emitter 20 is deformed, then any field concentration is no longer generated. For these reasons, every other part of the emitter 20 can be free from any destruction, melting or deformation. It is, therefore, possible to prevent any formation of a short circuit between the emitter 20 and the gate electrode 6. It is also possible to prevent a large deformation of the emitter 20. It is moreover possible that only the top of the emitter 20 may be vaporized, thereby resulting in a reduction in the amount of the vaporized contaminant. It is, therefore, possible to prevent any undesirable influence, due to the vaporized contaminant, against the adjacent field emission electron guns. In addition, the emitter 20 made of polysilicon including oxygen prevents any current fluctuation and provides a high current stability. Even if the undesirable short circuit is formed between the emitter 20 and the gate electrode 6, the relatively high resistance of the oxygen-containing polysilicon emitter 20 and the oxygen-containing polysilicon film 2 can cause a potential difference between the silicon substrate 1 and the gate electrode 6. This prevents any undesirable operational influence to the adjacent field emission electron guns.

The resistance of the emitter can readily be controlled by controlling the impurity concentration thereof. As a modification, it is possible to add oxygen by ion-implantation or other method than the chemical vapor deposition method described above. In addition, the emitter 20 may be made of a high resistive material, which is electrically conductive, other than the oxygen-containing polysilicon described above.

Figure 6:
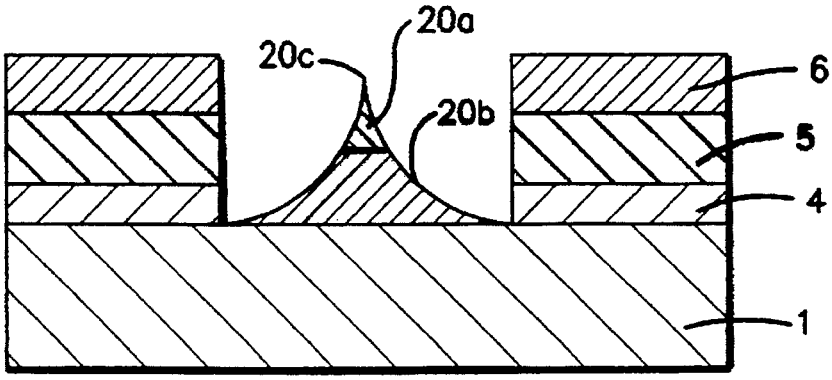
FIG. 6 is a fragmentary cross sectional elevation view illustrative of a novel field emission electron gun with an improved emitter structure in a third embodiment according to the present invention.

A third embodiment according to the present invention will be described in detail with reference to FIG. 6, which illustrates a structure of a novel field emission electron gun. An illustration of a collector electrode is omitted. In practice, many field emission electron guns are provided in matrix on an n-doped silicon substrate 1. An emitter electrode, which is not illustrated, may be provided on the bottom of the n-doped silicon substrate 1.

An emitter 20 is selectively provided on the top of the n-doped silicon substrate 1. The emitter 20 has a cone-like shape and is sharp-pointed at the top. The section area of the emitter 20 is simply decreased so that the slope of the side-face of the emitter 20 becomes increasingly steep in a direction toward the top. The emitter 20 comprises three parts: the first is a base 20*b*, the second is a head 20*a* placed on the base 20*b* and a top region 20*c* placed on the head 20*b*. The top region 20*c* corresponds to a region of several ten micrometers from the top sharp-pointed. The head 20*a* and the base 20*b* of the emitter 20 are made of polysilicon, which contains oxygen and are doped with an n-type impurity. The top region 20*c* of the emitter 20 is made of an oxygen-free polysilicon which is doped with an n-type impurity. The resistance of the emitter 20 is inversely proportional to the section area thereof. As described above, the section area of the emitter 20 is simply decreased in the direction toward the top. The oxygen-containing polysilicon of the emitter head 20*a* and the emitter base 20*b* has a larger resistivity than that of the n-doped oxygen-free polysilicon of the emitter top region 20*c*. The emitter 20 is designed so as to reduce the resistance of the emitter top. As a result, the discharge property of the emitter 20 is improved. The polysilicon of the emitter 20 has relatively small size crystal grains, wherein the grain size is uniform. The resistivity of the polysilicon depends on the grain size. The uniform grain size provides a uniform resistivity of the polysilicon, namely a fixed resistance of the emitter top region 20*c*. This structure can reduce the probability of current fluctuation.

A silicon oxide film 4 is selectively formed, on the top of the n-doped silicon substrate 1, at a predetermined annular area around the emitter 20. The silicon oxide film 4 is spaced apart from the emitter 20. The silicon oxide film 4 has a thickness in the range of 100–400 nanometers. An insulation film 5 is provided on the top of the silicon oxide film 4, to encompass and be spaced apart from the emitter 20. The insulation film 5 is made of silicon oxide and has a thickness in the range of 300–600 nanometers.

A gate electrode 6 made of molybdenum is provided on the top of the insulation film 5, to encompass and be spaced apart from the top of the emitter 20. The gate electrode 6 has a thickness in the range of about 200–300 nanometers.

As described above, the oxygen-containing polysilicon of the emitter head 20*a* and the emitter base 20*b* has a larger resistivity than that of the n-doped polysilicon of the emitter top region 20*c*. The emitter 20 is designed so as to reduce the resistance of the emitter top 20*c*. As a result, the discharge property of the emitter 20 is improved. Further, the low resistive region is formed only the top region 20*c* of several ten nanometers from the sharp-pointed top. Thus, the head, except for the top region 20*c*, is highly resistive. In fact, it is unavoidable that an excess electrical current may accidentally and temporally flow through the emitter at over a predetermined maximum regulation value. The above emitter structure is designed so that, even if such excess current at over the predetermined maximum regulation value flows through the emitter 20 accidentally and temporally, then only the head 20*a*, except for the top region 20*c*, of the emitter 20 may be broken, melted or deformed by an excess heat generation. If the head of the emitter 20 is deformed, then any field concentration is no longer generated. For these reasons, every other part of the emitter 20 can be free from any destruction, melting or deformation. It is, therefore, possible to prevent any formation of a short circuit between the emitter 20 and the gate electrode 6. It is also possible to prevent a large deformation of the emitter 20. It is moreover possible that only the head 20*a*, except for the sharp-pointed top 20*c*, may be vaporized, thereby resulting in a reduction in the amount of the vaporized contaminant. It is, therefore, possible to prevent any undesirable influence, due to the vaporized contaminant, against the adjacent field emission electron guns. In addition, the emitter 20, which is made of polysilicon including oxygen, except for the sharp-pointed top, prevents any current fluctuation and provides a high current stability. Even if the undesirable short circuit is formed between the emitter 20 and the gate electrode 6, the relatively high resistance of the oxygen-containing polysilicon emitter 20 and the oxygen-containing polysilicon film 2 can cause a potential difference between the silicon substrate 1 and the gate electrode 6. This prevents any undesirable operational influence to the adjacent field emission electron guns.

Figure 7:
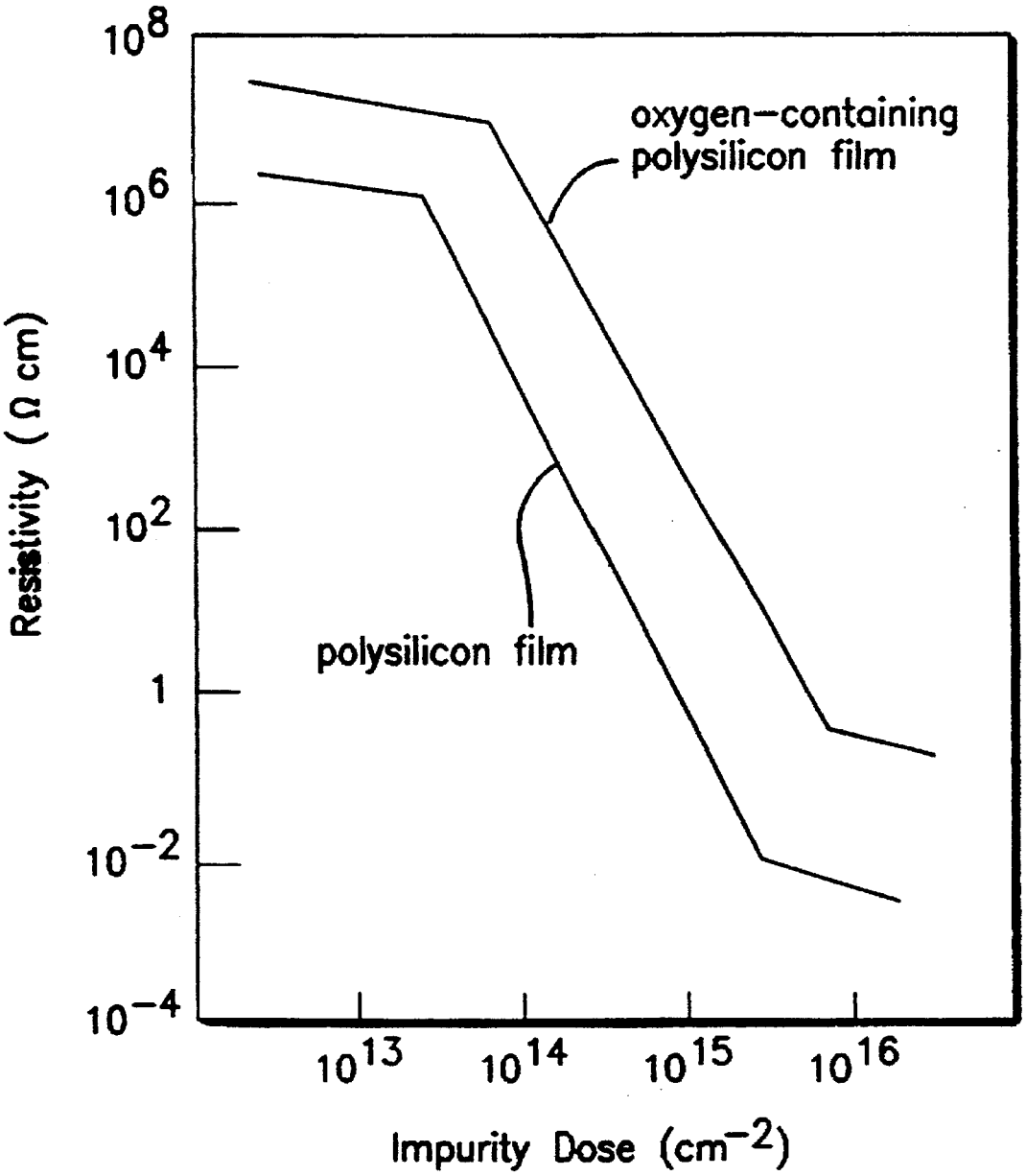
FIG. 7 is a diagram illustrative of the resistivity of each of oxygen-containing polysilicon and oxygen-free polysilicon versus phosphorus concentration.

FIG. 7 illustrates resistivities of oxygen-containing polysilicon and oxygen-free polysilicon versus the concentration of phosphorus. The resistivity of oxygen-containing polysilicon is higher by one order than the resistivity of oxygen-free polysilicon at the same phosphorus concentration. When the phosphorus concentration is below about $1\times10^{13}$ $cm^{-3}$, the variation of the resistivity of each of oxygen-free polysilicon and oxygen-free polysilicon is relatively small.

Figure 8:
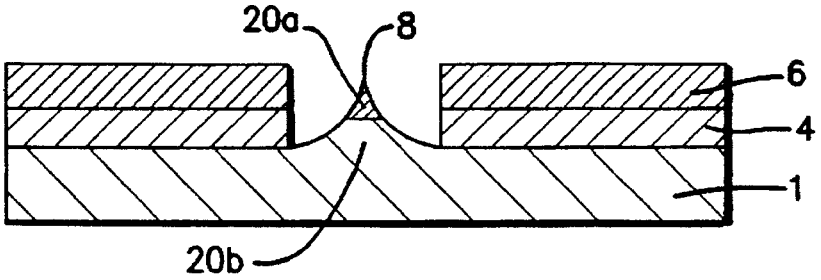
FIG. 8 is a fragmentary cross sectional elevation view illustrative of a novel field emission electron gun with an improved emitter structure in a fourth embodiment according to the present invention.

A fourth embodiment according to the present invention will be described in detail with reference to FIGS. 8 and 9A–9G. FIG. 8 illustrates a structure of a novel field emission electron gun, wherein an illustration of a collector electrode is omitted. In practice, many field emission electron guns are provided in matrix on an n-doped silicon substrate 1. An emitter electrode, which is not illustrated, may be provided on the bottom of the n-doped silicon substrate 1.

An emitter 20 is selectively provided on the top of the n-doped silicon substrate 1. The emitter 20 has a cone-like shape and is sharp-pointed at the top. The section area of the emitter 20 is simply decreased so that the slope of the side-face of the emitter 20 becomes increasingly steep in a direction toward the top. The emitter 20 comprises two parts: one is a base 20*b* and another is a head 20*a* placed on the base. The base 20*b* of the emitter 20 is made of the same material as the n-doped silicon substrate 1. The base 20*b* of the emitter 20 is formed to be united with the n-doped silicon substrate 1. The head 20*a* of the emitter 20 is made of polysilicon, which includes oxygen. The polysilicon, including oxygen, of the emitter head 20*a* has a larger resistivity than that of the n-doped silicon of the emitter base 20*b*. The resistance of the emitter 20 is inversely proportional to the section area thereof. As described above, the section area of the emitter 20 is simply decreased in the direction toward the top. For those reasons, the resistance of the emitter 20 is simply increased in the direction toward the top, so that the top of the emitter 20 has the highest resistance of every other part thereof. The polysilicon of the emitter head 20*a* has relatively small size crystal grains, wherein the grain size is uniform. The resistivity of the polysilicon depends on the grain size. The uniform grain size provides a uniform resistivity of the polysilicon, namely a uniform resistance of the emitter head 20*a*. This structure can reduce the probability of a current fluctuation. Further, the top of the emitter 20 is coated with a platinum silicide film 8 which has a lower resistivity, in order to reduce the resistance of the emitter top, so that the discharge property of the emitter 20 is improved.

A silicon oxide film 4 is selectively formed, on the top of the n-doped silicon substrate 1, at a predetermined annular area around the emitter base 20*b*. The silicon oxide film 4 is spaced apart from the emitter base 20*b*. The silicon oxide film 4 has a thickness in the range of 100–400 nanometers. An insulation film 5 is provided on the top of the silicon oxide film 4, to encompass and be spaced apart from the emitter 20. The insulation film 5 is made of silicon oxide and has a thickness in the range of 300–600 nanometers.

A gate electrode 6 made of molybdenum is provided on the top of the insulation film 5, to encompass and be spaced apart from the top of the emitter 20. The gate electrode 6 has a thickness in the range of about 200–300 nanometers.

In fact, it is unavoidable that an excess electrical current may accidentally and temporally flow through the emitter at over a predetermined maximum regulation value. The above emitter structure is designed so that, even if such excess current at over the predetermined maximum regulation value flows through the emitter 20 accidentally and temporally, then only the top of the emitter head 20*a* may be broken, melted or deformed by an excess heat generation. If the pointed top of the emitter head 20*a* is deformed, then any field concentration is no longer generated. For these reasons, every other part of the emitter 20 can be free from any destruction, melting or deformation. It is, therefore, possible to prevent any formation of a short circuit between the emitter 20 and the gate electrode 6. It is also possible to prevent a large deformation of the emitter 20. It is moreover possible that only the top of the emitter 20 may be vaporized, thereby resulting in a reduction in the amount of the vaporized contaminant. It is, therefore, possible to prevent any undesirable influence, due to the vaporized contaminant, against the adjacent field emission electron guns. In addition, the emitter head 20*a* made of polysilicon including oxygen prevents any current fluctuation and provides a high current stability. Further, the platinum silicide film 8, which coats the top of the emitter 20, has a lower resistivity, thereby resulting in a reduction in the resistance of the emitter top, so that the discharge property of the emitter 20 is improved.

In place of the platinum silicide film 8, other silicide film such as a tungsten silicide film and a titanium silicide film are available, and further any metal film such as a titanium film and a tungsten film are also available.

Figure 9A:
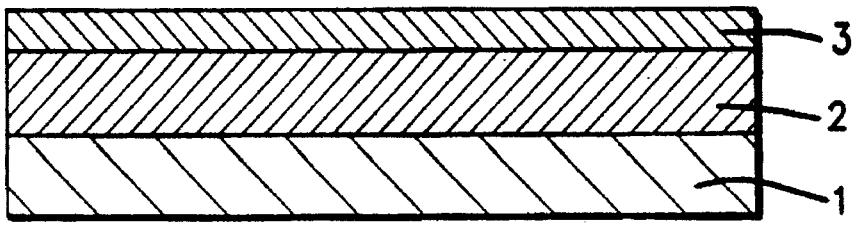
FIGS. 9A–9G are fragmentary cross sectional elevation view illustrative of novel field emission electron guns in sequential processes involved in a fabrication method in a fourth embodiment according to the present invention.

The above field emission electron gun may be fabricated as follows. As illustrated in FIG. 9A, a silicon substrate 1 is doped with an n-type impurity. A polysilicon film 2, including oxygen and having a thickness about 300 nanometers, is deposited on the top of the n-doped silicon substrate 1 by a chemical vapor deposition method, wherein $N_2O$ gas is added to the normal source gas. The oxygen-containing polysilicon film 2 is doped with an impurity by an ion-implantation. A silicon nitride film, having a thickness about 100 nanometers, is deposited on the top of the polysilicon film 2.

Figure 9B:
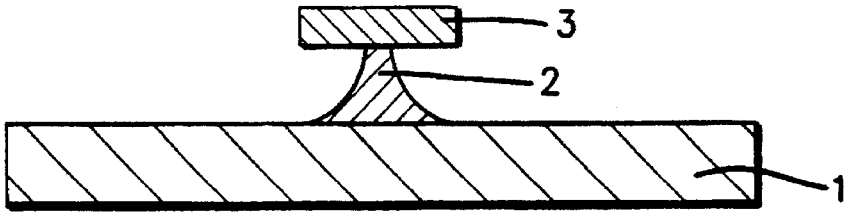

As illustrated in FIG. 9B, a photo-resist film, not illustrated, is applied on the top of the silicon nitride film 3. The photo-resist film is patterned. The silicon nitride film 3 is selectively etched by use of the photo-resist as a mask so that the silicon nitride film 3 remains under the photo-resist film. As a result, the oxygen-containing polysilicon film 2 is partially covered with the remaining silicon nitride film 3. After removing the photo-resist film, the oxygen-containing polysilicon film 2 is subjected to an isotropic etching which uses $SF_6$ gas, thereby resulting in a truncated cone-like oxygen-containing polysilicon 2 trader the remaining silicon nitride film 3. The section area of the truncated cone-like oxygen-containing polysilicon 2 is simply decreased so that the slope of the side-face thereof becomes increasingly steep in a direction toward the top.

Figure 9C:
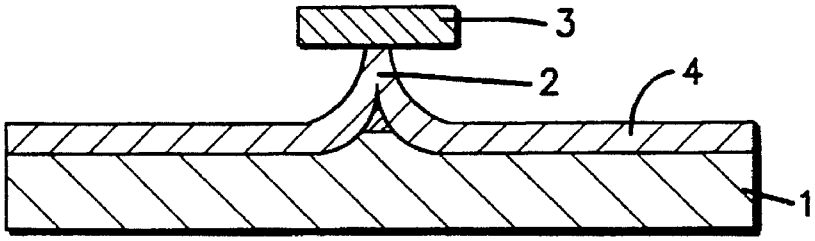

As illustrated in FIG. 9C, the top surface of the silicon substrate 1 and the surface of the truncated cone-like oxygen-containing polysilicon 2 are subjected to a thermal oxidation of silicon. As a result, the top surface of the silicon substrate 1 and the surface of the truncated cone-like oxygen-containing polysilicon 2 are transformed to a silicon oxide film 4. The truncated cone-like shaped oxygen-containing polysilicon 2 is transformed to a sharp-pointed cone oxygen-containing polysilicon 2 under the silicon oxide film 4. A truncated cone-like silicon base is formed under the sharp-pointed cone oxygen-containing polysilicon 2. The truncated cone-like silicon base serves as an emitter base. The sharp-pointed cone oxygen-containing polysilicon 2 serves as an emitter head. The combination of the emitter head and base constitute an emitter which has a cone-like shape and is sharp-pointed at the top. The section area of the emitter is simply decreased so that the slope of the side-face of the emitter becomes increasingly steep in a direction toward the top.

Figure 9D:
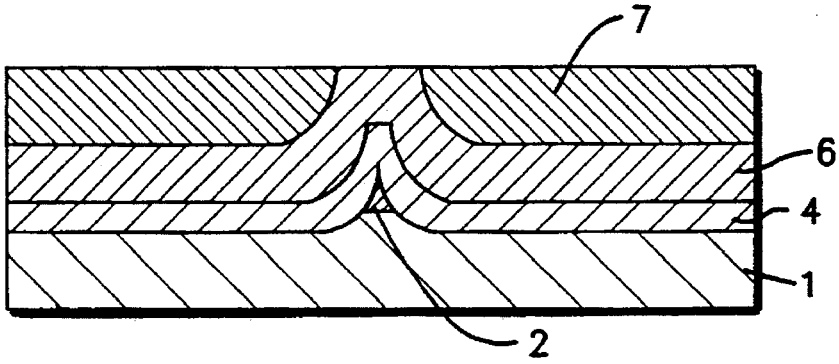

As illustrated in FIG. 9D, the silicon nitride film 3 is removed by an etchant containing a phosphorus acid. A gate electrode film 6, being made of molybdenum or tungsten and having a thickness of about 200 nanometers, is deposited, by either a chemical vapor deposition method or a sputtering method, on the silicon oxide film 4. The gate electrode film 6 has the truncated cone like portion over the truncated cone like portion of the silicon oxide film, which covers the sharp-pointed emitter 20. A photo-resist film 7 is applied, until the top of the truncated cone like portion of the gate electrode film 6 is immersed in the photo-resist film 7. The photo-resist film is then subjected to an etch-back, so that the top surface of the photo-resist film is level to the top of the truncated cone like portion of the gate electrode film 6. As a result, the top of the truncated cone like portion of the gate electrode film 6 is shown.

Figure 9E:
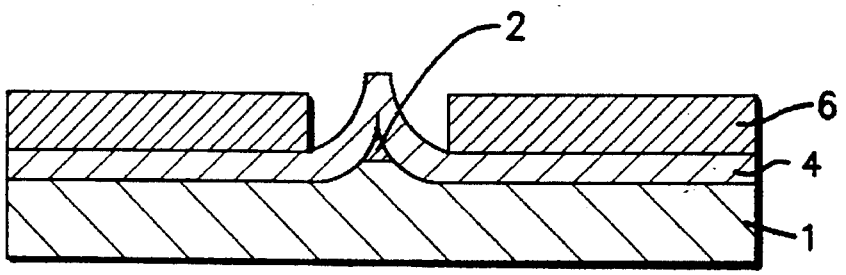

As illustrated in FIG. 9E, the gate electrode film 6 is selectively etched by use of the photo-resist film 7 as a mask. The truncated cone like portion of the silicon oxide film 4 is shown. The photo-resist film 7 is then removed.

Figure 9F:
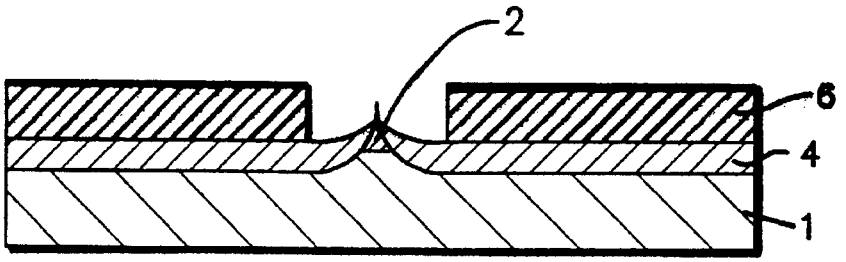

As illustrated in FIG. 9F, the truncated cone like portion of the silicon oxide film 4 is subjected to an isotropic etching of an HF etchant, wherein the gate electrode film 6 as a mask. As a result, only the top of the emitter head 2 is shown.

Figure 9G:
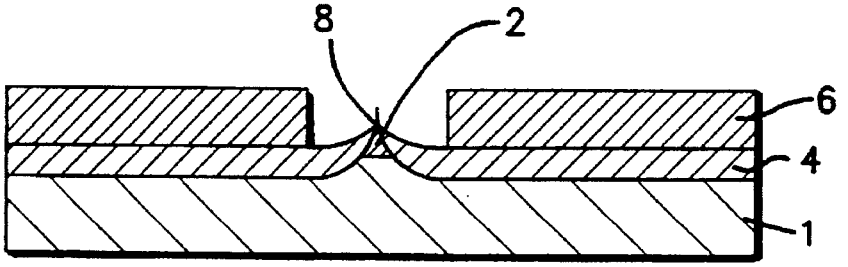

As illustrated in FIG. 9G, a platinum film, having a thickness of about 30 nanometers, is deposited by sputtering on the surface of the device. The platinum film is then subjected to a heat treatment at a temperature in the range of 500°–600° C., so that the platinum film on only the top of the emitter head 2 is transformed to a platinum silicide film 8. Every other part of the platinum film remains unchanged. The remaining platinum film is removed by aqua regia, thereby the fabrication processes of the field emission electron gun is completed.

The resistance of the emitter can readily be controlled by controlling the impurity concentration thereof. As a modification, it is possible to add oxygen by ion-implantation or other method than the chemical vapor deposition method described above. In addition, the emitter head 20*a* may be made of a high resistive material, which is electrically conductive, other than the oxygen-containing polysilicon described above.

Whereas modifications of the present invention will be apparent to a person having ordinary skill in the art, to which the invention pertains, it is to be understood that embodiments as shown and described by way of illustrations are by no means intended to be considered in a limiting sense. Accordingly, it is intended that the claims cover all modifications which fall within the spirit and scope of the present invention.

What is claimed is:

1. An emitter structure of a field emission electron gun, said emitter structure comprising: an emitter being electrically conductive and being pointed at the top, wherein the top of said emitter has the highest resistance of every other part, so that the top of said emitter has the highest heat energy of every other part when said emitter emits electrons.

2. The emitter structure as claimed in claim 1, wherein said emitter has the resistance which is simply increased in a direction toward the top of said emitter.

3. The emitter structure as claimed in claim 2, wherein said emitter has the section area which is simply decreased in a direction toward the top of said emitter.

4. The emitter structure as claimed in claim 3, wherein said emitter has a cone-like shape.

5. The emitter structure as claimed in claim 3, wherein said emitter has a pyramid-like shape.

6. The emitter structure as claimed in claim 1, wherein said emitter is made of a single conductive material.

7. The emitter structure as claimed in claim 6, wherein said single conductive material is a polysilicon which includes oxygen and is doped with an impurity.

8. The emitter structure as claimed in claim 1, wherein said emitter comprises:

a base being made of a first material having a first resistivity; and a head being provided on said base, said head being made of a second material having a second resistivity which is higher than said first resistivity, so that said head has a higher heat energy than that of said base when said emitter emits electrons.

9. The emitter structure as claimed in claim 7, wherein said first material is a silicon doped with an impurity, and wherein said second material is a polysilicon which includes oxygen and is doped with an impurity.

10. The emitter structure as claimed in claim 1, wherein the top of said emitter is coated with a third material having a third resistivity which is lower than said second resistivity.

11. The emitter structure as claimed in claim 10, wherein said third material is silicide.

12. The emitter structure as claimed in claim 11, wherein said silicide is platinum.

13. The emitter structure as claimed in claim 11, wherein said silicide is titanium silicide.

14. The emitter structure as claimed in claim 11, wherein said silicide is tungsten silicide.

15. The emitter structure as claimed in claim 11, wherein said silicide is molybdenum silicide.

16. The emitter structure as claimed in claim 10, wherein said third material is a metal.

17. The emitter structure as claimed in claim 16, wherein said metal is titanium.

18. The emitter structure as claimed in claim 16, wherein said metal is tungsten.

19. The field emission electron gun as claimed in claim 16, wherein said metal is molybdenum.

20. A field emission electron gun comprising:

a semiconductor substrate;

an emitter being electrically conductive and being pointed at the top, said emitter being selectively provided on said semiconductor substrate;

a gate insulation material being selectively provided, on said semiconductor substrate, at a predetermined area around said emitter; and a gate electrode being provided on said insulation material to encompass the top of said emitter, said gate electrode being spaced from said emitter, wherein the top of said emitter has the highest resistance of every other part, so that the top of said emitter has the highest heat energy of every other part when said emitter emits electrons.

21. The field emission electron gun as claimed in claim 20, wherein said emitter has the resistance which is simply increased in a direction toward the top of said emitter.

22. The field emission electron gun as claimed in claim 21, wherein said emitter has the section area which is simply decreased in a direction toward the top of said emitter.

23. The field emission electron gun as claimed in claim 22, wherein said emitter has a cone-like shape.

24. The field emission electron gun as claimed in claim 22, wherein said emitter has a pyramid-like shape.

25. The field emission electron gun as claimed in claim 20, wherein said emitter is made of a single conductive material.

26. The field emission electron gun as claimed in claim 25, wherein said single conductive material is a polysilicon which includes oxygen and is doped with an impurity.

27. The field emission electron gun as claimed in claim 20, wherein said emitter comprises:

a base being made of a first material having a first resistivity; and a head being placed on said base, said head being made of a second material having a second resistivity which is higher than said first resistivity, so that said head has a higher heat energy than that of said base when said emitter emits electrons.

28. The field emission electron gun as claimed in claim 27, wherein said first material is a silicon doped with an impurity, and wherein said second material is a polysilicon which includes oxygen and is doped with an impurity.

29. The field emission electron gun as claimed in claim 20, wherein the top of said emitter is coated with a third material having a third resistivity which is lower than said second resistivity.

30. The field emission electron gun as claimed in claim 29, wherein said third material is silicide.

31. The field emission electron gun as claimed in claim 30, wherein said silicide is platinum.

32. The field emission electron gun as claimed in claim 30, wherein said silicide is titanium silicide.

33. The field emission electron gun as claimed in claim 30, wherein said silicide is tungsten silicide.

34. The field emission electron gun as claimed in claim 30, wherein said silicide is molybdenum silicide.

35. The field emission electron gun as claimed in claim 29, wherein said third material is a metal.

36. The field emission electron gun as claimed in claim 35, wherein said metal is titanium.

37. The field emission electron gun as claimed in claim 35, wherein said metal is tungsten.

38. The field emission electron gun as claimed in claim 35, wherein said metal is molybdenum.

39. The field emission electron gun as claimed in claim 20, wherein said gate electrode is made of a metal.

40. The field emission electron gun as claimed in claim 39, wherein said metal is molybdenum.

41. The field emission electron gun as claimed in claim 39, wherein said metal is titanium.

42. The field emission electron gun as claimed in claim 39, wherein said metal is tungsten.

43. The field emission electron gun as claimed in claim 20, wherein said semiconductor substrate comprises a silicon doped with an impurity.

44. The field emission electron gun as claimed in claim 43, wherein said gate insulation material comprises silicon oxide.

45. A field emission electron gun comprising:

a semiconductor substrate;

an emitter being electrically conductive and being selectively provided on said semiconductor substrate, said emitter having the section area which is simply decreased in a direction toward the top of said emitter so that said emitter is pointed at the top, and said emitter comprising:

a base being made of polysilicon including oxygen and being doped with an impurity;

a head being placed on said base, said head being made of polysilicon including oxygen and being doped with an impurity; and a top region being placed on said head, said top region being doped with an impurity;

a gate insulation material being selectively provided, on said semiconductor substrate, at a predetermined area around said emitter; and a gate electrode being provided on said insulation material to encompass the top of said emitter, said gate electrode being spaced from said emitter, wherein said head has the highest resistance of every other part, so that said head has the highest heat energy of every other part when said emitter emits electrons.

46. The field emission electron gun as claimed in claim 45, wherein said emitter has a cone-like shape.

47. The field emission electron gun as claimed in claim 45, wherein said emitter has a pyramid-like shape.

48. The field emission electron gun as claimed in claim 45, wherein the top of said emitter is coated with a silicide.

49. The field emission electron gun as claimed in claim 48, wherein said silicide is platinum silicide.

50. The field emission electron gun as claimed in claim 48, wherein said silicide is titanium silicide.

51. The field emission electron gun as claimed in claim 48, wherein said silicide is tungsten silicide.

52. The field emission electron gun as claimed in claim 48, wherein said silicide is molybdenum silicide.

53. The field emission electron gun as claimed in claim 45, wherein the top of said emitter is coated with a metal.

54. The field emission electron gun as claimed in claim 53, wherein said metal is titanium.

55. The field emission electron gun as claimed in claim 53, wherein said metal is tungsten.

56. The field emission electron gun as claimed in claim 53, wherein said metal is molybdenum.

57. The field emission electron gun as claimed in claim 45, wherein said gate electrode is made of a metal.

58. The field emission electron gun as claimed in claim 57, wherein said metal is molybdenum.

59. The field emission electron gun as claimed in claim 57, wherein said metal is titanium.

60. The field emission electron gun as claimed in claim 57, wherein said metal is tungsten.

61. The field emission electron gun as claimed in claim 45, wherein said semiconductor substrate comprises a silicon doped with an impurity.

62. The field emission electron gun as claimed in claim 61, wherein said gate insulation material comprises silicon oxide.

63. An emitter of a field emission electron gun, said emitter being electrically conductive and having the section area which is simply decreased in a direction toward the top of said emitter so that said emitter is pointed at the top, and said emitter comprising:

a base being made of polysilicon including oxygen and being doped with an impurity;

a head being placed on said base, said head being made of polysilicon including oxygen and being doped with an impurity; and a top region being placed on said head, said top region being doped with an impurity, wherein said head has the highest resistance of every other part, so that said head has the highest heat energy of every other part when said emitter emits electrons.

64. The field emission electron gun as claimed in claim 63, wherein said emitter has a cone-like shape.

65. The field emission electron gun as claimed in claim 63, wherein said emitter has a pyramid-like shape.

66. The field emission electron gun as claimed in claim 63, wherein the top of said emitter is coated with a silicide.

67. The field emission electron gun as claimed in claim 66, wherein said silicide is platinum silicide.

68. The field emission electron gun as claimed in claim 66, wherein said silicide is titanium silicide.

69. The field emission electron gun as claimed in claim 66, wherein said silicide is tungsten silicide.

70. The field emission electron gun as claimed in claim 66, wherein said silicide is molybdenum silicide.

71. The field emission electron gun as claimed in claim 63, wherein the top of said emitter is coated with a metal.

72. The field emission electron gun as claimed in claim 71, wherein said metal is titanium.

73. The field emission electron gun as claimed in claim 71, wherein said metal is tungsten.

74. The field emission electron gun as claimed in claim 71, wherein said metal is molybdenum.

* * * * *